United States Patent [19]

Anchia

[11] Patent Number: 5,013,036

[45] Date of Patent: May 7, 1991

[54] EXERCISE APPARATUS

[76] Inventor: Carlos Anchia, 3528 Copper Kettle Way, Orange, Calif. 92667

[21] Appl. No.: 557,602

[22] Filed: Jul. 23, 1990

[51] Int. Cl.[5] ..... A63B 21/055

[52] U.S. Cl. ..... 272/137; 272/142

[58] Field of Search ..... 272/67, 114, 116, 125, 272/135, 136, 137, 138, 142, 145, 900, 901

[56] References Cited

U.S. PATENT DOCUMENTS

| | | | |
|---|---|---|---|
| 3,337,215 | 8/1967 | Melchiona | 272/142 X |
| 4,463,948 | 8/1984 | Mohr | 272/142 X |
| 4,634,114 | 1/1987 | Garcia | 272/67 |
| 4,775,149 | 10/1988 | Wilson | 272/137 X |

*Primary Examiner*—Richard J. Apley
*Assistant Examiner*—L. Thomas

[57] ABSTRACT

An excercise apparatus comprises a flexible, axially-resilient member having two first longitudinal sections each having a first resistance to stretching and two second longitudinal sections each having a second resistance to stretching. The first and second longitudinal sections are arranged in series with one of the first longitudinal sections at one axial end of the apparatus and the other one of the first longitudinal sections at the other axial end of the apparatus. The first and second longitudinal sections are constructed of either natural rubber or neoprene, and are in the shape of a continuous tube having a uniform outer diameter and a uniform wall thickness. Each of the first longitudinal sections is formed having at least one first longitudinal opening in the wall of the tube whereby the cross sectional area of the tube in the region of such opening is equal to a first cross sectional area; each of the second longitudinal sections is formed having at least one second longitudinal opening in the wall of the tube whereby the cross sectional area of the tube in the region of such opening is equal to a second cross sectional area which is substantially greater than the first cross sectional area, the second longitudinal sections thereby having a resistance to stretching which is substantially greater than that of the first longitudinal sections. The apparatus further comprises gripping members installed on each end of the apparatus and between each adjacent pair of the longitudinal sections.

31 Claims, 1 Drawing Sheet

10
12
12a
14
14a
16
20
22
24
26
T
D
D1
D2
W1
W2
L
l1
l2
Δl1
2
3
4

EXERCISE APPARATUS

BACKGROUND OF THE INVENTION

1. Field of the Invention

The present invention relates generally to the field of apparatus and, more particularly, to hand-held, stretchable exercise apparatus.

2. Discussion of the Prior Art

A great many types of exercise and body-building apparatus are available for use by individuals seeking to improve or maintain their muscular development, their cardiac function and/or overall body condition. Many of such apparatus are expensive and/or require more floor space than may conveniently be available in homes and apartments. Examples of such apparatus are rowing machines, some types of large stationary bicycles, and various types of NAUTILUS brand body-building machines.

While much of such exercise and body building apparatus is practical for use in health clubs, most is not practical for home, apartment, or office use. The use of health club facilities is not, however, practical for many individuals who simply cannot afford the often expensive charges made by most health clubs for the use of their facilities. Moreover, even for those who can afford health club charges, the use of health club facilities is frequently inconvenient for working or otherwise busy people. The facilities are not always conveniently located for frequent use, the equipment provided by the health clubs may be in use by others, and the visiting of such clubs may take at least one or two hours, by the time driving and parking time and the time required for changing from street clothes into appropriate exercise clothing is considered.

In any event, many individuals want the convenience of exercising at home, in their apartments or workplaces or when they are away from home on trips or vacations. As a result, a number of small, portable exercising apparatus have been made available to the public. Several of these types comprise two handles with springs of some sort connected therebetween. An individual exercises his or her arm and shoulder muscles by holding one handle in each hand and pulling the hands apart against the resisting tensional force of the springs.

A disadvantage of such known and heretofore available exercising apparatus is that the apparatus requires uniform pulling force which may be too high for some individuals and too low for others. Moreover, the same individual may not want the same pulling force all the time. For purposes of physical therapy, or for beginners, for instance, it may be desired to start at a low pulling force and later increase the force as the individual's muscles build up. Still further, an individual may not always want to exercise to the maximum, but may want somewhat lesser exercise to relax or ease tensions.

It is, therefore, a principal objective of the present invention to provide a relatively simple, inexpensive and readily portable exercise device of the tension type which enables the pulling force to be selected between two or more pulling forces.

SUMMARY OF THE INVENTION

In accordance with the present invention there is provided an exercise apparatus which comprises a flexible, axially resilient member having a plurality of first longitudinal sections each having a first resistance to stretching and a plurality of second longitudinal sections each having a second resistance to stretching. The second resistance to stretching is greater than the first resistance to stretching and the plurality of first longitudinal sections and the plurality of second longitudinal sections are serially arranged.

In accordance with a preferred embodiment of the invention, at least two of the plurality of second longitudinal sections are longitudinally adjacent to one another and one of the first longitudinal sections is at one axial end of the apparatus and another one of the first longitudinal sections is at the other axial end of the apparatus. Further in accordance with the preferred embodiment, there are included gripping members installed on each end of the apparatus and between each adjacent pair of the first and second longitudinal sections.

It is preferred that the first and second longitudinal sections are made of an elastomeric material, such as natural rubber or neoprene, and that the elastomeric material is in the shape of an elongate tube having a uniform outer diameter and having a uniform wall thickness. In such case, each of the first longitudinal sections is formed having at least one, and preferably two, first longitudinal openings in the wall of the tube whereby the cross sectional area of the tube in the region of the first longitudinal opening is equal to a first cross sectional area. Preferably, each of the second longitudinal sections is also formed having at least one, and preferably two, second longitudinal openings in the wall of the tube, the relative sizes of the first and second openings in the tube wall being such that the cross sectional area of the tube in the region of such second longitudinal opening is equal to a second cross sectional area which is substantially greater than the first cross sectional area. As a result, the second longitudinal sections require more force to be stretched a given distance than is required to stretch the first longitudinal sections. The first and second openings in the wall the tube also permit the apparatus to be detachably mounted for use over some fixed object, such as a door knob.

The exercise apparatus of the present invention is thus inexpensive to construct, is convenient to use anywhere and is easy to pack into a suitcase for travel and vacation use.

BRIEF DESCRIPTION OF THE DRAWINGS

The present invention can be more readily understood by a consideration of the following detailed description when taken in conjunction with the accompanying drawings, in which:

FIG. 5*b* is a cross sectional view, taken in the plane of FIG. 3, of a variation second longitudinal section having a solid cross section.

In the various FIGS. like elements and features are given the same reference number and/or other identification, and corresponding elements and features are identified with the original reference number followed by an "a".

DESCRIPTION OF THE PREFERRED EMBODIMENT

Figures 1, 2, 3, 4, 5, 6:
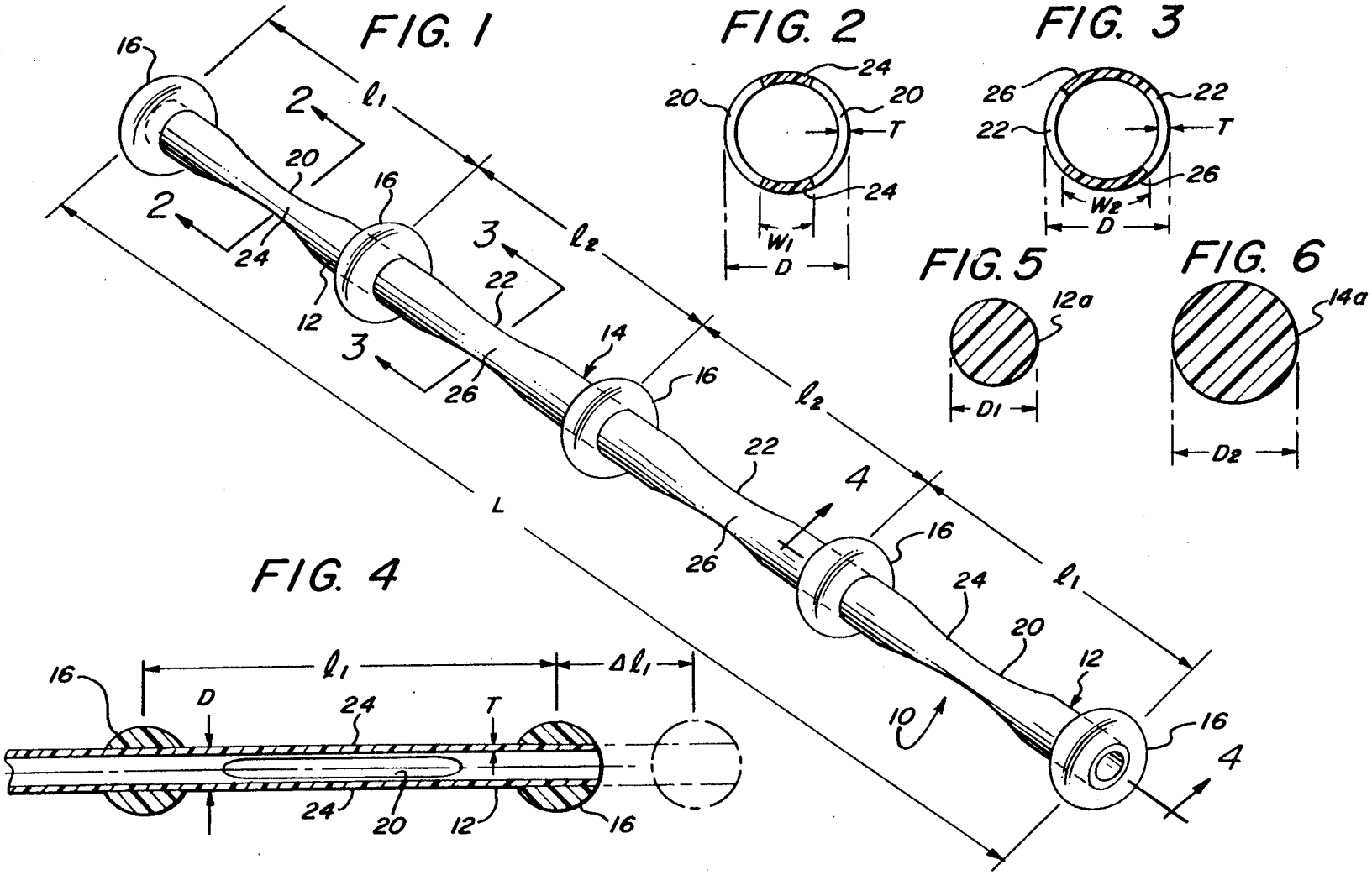
FIG. 1 is a perspective drawing of the exercise apparatus in its static, unstretched state, and showing an exemplary two first longitudinal tension sections and two second longitudinal tension sections, the first sections being easier to stretch than the second sections.
FIG. 2 is a transverse cross sectional view taken along line 2—2 of FIG. 1, showing one of the first sections of the apparatus having a tubular transverse cross section with side wall openings.
FIG. 3 is a transverse cross sectional drawing taken along line 3—3 of FIG. 1, showing one of the second sections of the apparatus having a tubular transverse cross section with smaller side wall openings.
FIG. 4 is a longitudinal cross sectional view taken along line 4—4 of FIG. 1, showing one of the first sections of the apparatus and one of the side wall openings therein; and, FIG. 5*a* is a cross sectional view, taken in the plane of FIG. 2, of a variation first longitudinal section having a solid cross section

There is depicted in FIG. 1 a stretchable exercise apparatus 10 in accordance with a preferred embodiment of the present invention. Generally comprising exercise apparatus 10 are a plurality of first longitudinal tension sections or elements 12, each having a length, $l_1$, and a plurality of second longitudinal tension sections or elements 14, each having a length, $l_2$, the first and second longitudinal sections being arranged in a serial manner to form exercise apparatus having an overall length L. By way of example and with no limitation being either intended or implied, section lengths $l_1$ and $l_2$ may each be about nine inches long.

As shown and described herein, second longitudinal tension sections 14 have a different stretching characteristic than that of first longitudinal tension sections 12, the second longitudinal tension sections requiring more stretching force to stretch them a given distance than do the first longitudinal tension sections.

As shown in FIG. 1, only two first longitudinal tension sections 12 are provided, one such section being at each end of apparatus 10, and only two second longitudinal tension sections 14 are provided, the second longitudinal tension sections being axially adjacent to one another in middle regions of exercise apparatus 10. For a combined total of four first and second longitudinal sections 12 and 14 and for assumed longitudinal sections lengths, $l_1$ and $l_2$ of about nine inches, apparatus 10 has an overall length, L, of about 36 inches.

It is, however, to be appreciated that more than two different types of longitudinal sections, such as sections 12 and 14 shown in FIG. 1, may be provided and that different arrangements of the sections may be provided. In the latter case, for example, the two second longitudinal sections 14 may be at ends of apparatus 10 instead of the two first longitudinal sections 12. In such case, for the four sections shown, first longitudinal sections 12 would be axially adjacent to one another.

Further comprising exercise apparatus 10, as shown in FIG. 1, are a number of ball-shaped gripping members 16. One of members 16 is mounted (that is, fixed) at one end of exercise apparatus 10 and another one of the members is mounted at the other end of the apparatus. Intermediate ones of members 16 are mounted between each adjacent pair of longitudinal sections 12 and 14. Thus, for the four longitudinal sections 12 and 14 illustrated in FIG. 1, a total of five members 16 are provided (two at the ends and three intermediate the ends). Members 16 may be fixedly mounted to apparatus 10 by cementing. If, as an illustration, first and second longitudinal tension sections are round in transverse cross section (as depicted in FIGS. 2 and 3) and are about 1½ inches in outer diameter, gripping members may each be about three inches in diameter.

As shown in FIGS. 2–4, respective longitudinal tension sections 12 and 14 may be constructed in tubular form. Preferably, for reasons such as effectiveness, ease in manufacture, and low cost, exercise apparatus 10 is constructed of a long, continuous tube of a tough elastic material, such as natural rubber or neoprene. In such case, first and second longitudinal sections 12 and 14 are merely defined sections of the tube which are separated by members 16. Preferably, in such case, the tube, and thus, first and second longitudinal sections 12 and 14 (and any other sets of longitudinal sections which may be provided), has a uniform outside diameter, D, and a uniform wall thickness, T. By way of example, outer diameter, D, may be about 1½ inches and wall thickness, T, may be about ⅛th inch to 3/16th of an inch.

Considering that first and second longitudinal sections 12 and 14, respectively, are constructed of a tubular elastomeric material having a uniform outer diameter, D, and a uniform wall thickness, T, the different tension characteristics of the first and second longitudinal sections is readily achieved, as shown in FIGS. 2 and 3, by cutting respective, elongate longitudinal side openings 20 and 22 in the side wall of the tube. As shown in FIGS. 1 and 4, side wall openings 20 in first longitudinal sections 12 extend longitudinally over a substantial portion of the length, $l_1$, of such sections; similarly, side wall openings 22 extend longitudinally over a substantial portion of the length, $l_2$, of second longitudinal sections 14. In this regard, as shown in FIG. 2, two side openings 20 are cut in the side wall of first elongate sections 12. Preferably, side wall openings 20 are of the same size and are symmetrical, thereby leaving two intact segments 24 of the tube 180 degrees apart, each of such segments of tube having a width (actually an arc length), $W_1$. Segments 24 have a combined transverse cross sectional area, $A_1$, equal to $2 \times w_1 x T$, which is the transverse cross sectional area of first sections 12 (and of the tube) in the region of openings 20. In a similar manner, second sections 14 are formed with opposing, symmetrical side wall openings 20 which leave two tube segments each having a width (actually, an arc length) of $W_2$, and a combined transverse cross sectional area, $A_2$, equal to $2 \times W_2 x T$.

In the preferred embodiment described herein, transverse cross sectional area, $A_2$, of second longitudinal sections 14 is made substantially greater that transverse cross sectional area, $A_1$, of first longitudinal sections 12 by making sidewall openings 20 of the first longitudinal sections wider than side wall openings 22 of the second longitudinal sections. As a result, the force required to stretch first longitudinal section 12 an amount, delta $l_1$ (FIG. 4), is substantially less than the force required to stretch one of second longitudinal sections 14 the same amount. Stated differently, the application of a given stretching force will stretch a first longitudinal section 12 a greater amount than the same force will stretch a second longitudinal section 14, the amount of stretching for a given force for a first section 12 as compared to a second section 14 being proportional to $A_2$ divided by $A_1$.

It will, of course, be appreciated that the same effect of making the transverse cross sectional areas of first and second longitudinal sections 12 and 14, respectively, in the regions of respective openings 20 and 22 can be achieved in a number of different, but comparable manners. For instance, as depicted in FIGS. 5*a* and 5*b*, a corresponding first longitudinal section 12*a* may be formed of a solid (that is, a non-tubular) elastomeric material having a diameter, $D_1$, which is substantially less than a diameter, $D_2$, of a comparable second longitudinal section 14a. In such case, respective transverse cross sectional areas, $A_1$ and $A_2$, can still be maintained. In another variation, first and second sections 12 and 14 may be constructed of a different number of strands of elastomeric material, achieving the same results as depicted for a solid tube in FIG. 5.

Although there is described above a specific arrangement of a tension-type exercise apparatus, and a variation thereof, in accordance with the present invention for the purposes of illustrating the manner in which the invention can be used to advantage, it is to be appreciated that the invention is not limited thereto. Accordingly, any and all modifications which may occur to those skilled in the art are to be considered to be within the scope and spirit of the invention as defined by the appended claims.

What is claimed is:

1. An exercise apparatus which comprises a flexible, axially-resilient member having a plurality of first longitudinal sections each having a first resistance to stretching and a plurality of second longitudinal sections each having a second resistance to stretching, said second resistance to stretching being greater than said first resistance to stretching and said plurality of first longitudinal sections and said plurality of second longitudinal sections being arranged in series with one another.

2. The exercise apparatus as claimed in claim 1, wherein at least two of the plurality of second longitudinal sections are longitudinally adjacent to one another.

3. The exercise apparatus as claimed in claim 1, wherein one of said plurality of first longitudinal sections is at one axial end of the apparatus and another one of said plurality of first longitudinal sections is at the other axial end of the apparatus.

4. The exercise apparatus as claimed in claim 1, wherein said plurality of first and second longitudinal sections are made of an elastomeric material.

5. The exercise apparatus as claimed in claim 4, wherein said elastomeric material is in the shape of a tube having a uniform outer diameter and having a uniform wall thickness.

6. The exercise apparatus as claimed in claim 5, wherein each of said first longitudinal sections is formed having at least one first longitudinal opening in the wall of said tube whereby the cross sectional area of the tube in the region of said at least one first longitudinal opening is equal to a first cross sectional area.

7. The exercise apparatus as claimed in claim 6, wherein each of said second longitudinal sections is formed having at least one second longitudinal opening in the wall of said tube whereby the cross sectional area of the tube in the region of said at least one second longitudinal opening is equal to a second cross sectional area which is substantially greater than said first cross sectional area.

8. The exercise apparatus as claimed in claim 4, wherein said material is selected from the group consisting of natural rubber and neoprene.

9. The exercise apparatus as claimed in claim 4, wherein each of said plurality of first longitudinal sections has a smaller transverse cross sectional area than that of each of said plurality of second longitudinal sections.

10. The exercise apparatus as claimed in claim 4, wherein said plurality of first longitudinal sections and said plurality of second longitudinal sections reconstructed as a single, continuous piece of said elastomeric material.

11. The exercise apparatus as claimed in claim 1, wherein at least two of the plurality of second longitudinal sections are longitudinally adjacent to one another and wherein one of said plurality of first longitudinal sections is at one axial end of the apparatus and another of said plurality of first longitudinal sections is at the other end of the apparatus.

12. The exercise apparatus as claimed in claim 11, wherein there are two of said first longitudinal sections and two of said second longitudinal sections.

13. The exercise apparatus as claimed in claim 1, including gripping members installed on each end of the apparatus and between each adjacent pair of said longitudinal sections.

14. An exercise apparatus which comprises a flexible, axially-resilient member having a plurality of first longitudinal sections each having a first resistance to stretching and a plurality of second longitudinal sections each having a second resistance to stretching, said second resistance to stretching being greater than said first resistance to stretching, and said plurality of first longitudinal sections and said plurality of second longitudinal sections being arranged in series with one another and being constructed of an elastomeric material, each of said plurality of first longitudinal sections having a smaller transverse cross sectional area than that of each of said plurality of second longitudinal sections.

15. The exercise apparatus as claimed in claim 14, wherein at least two of the plurality of second longitudinal sections are longitudinally adjacent to one another.

16. The exercise apparatus as claimed in claim 15, wherein one of said plurality of first longitudinal sections is at one axial end of the apparatus and another one of said first longitudinal sections is at the other axial end of the apparatus.

17. The exercise apparatus as claimed in claim 15, wherein said elastomeric material is in the shape of a tube having a uniform outer diameter and a uniform wall thickness.

18. The exercise apparatus as claimed in claim 17, wherein each of said first longitudinal sections is formed having at least one first longitudinal opening in the wall of said tube whereby the cross sectional area of the tube in the region of said at least one first longitudinal opening is equal to a first cross sectional area and wherein each of said second longitudinal sections is formed having at least one second longitudinal opening in the wall of said tube whereby the cross sectional area of the tube in the region of said at least one second longitudinal opening is equal to a second cross sectional area which is substantially greater than said first cross sectional area.

19. The exercise apparatus as claimed in claim 14, wherein said elastomeric material is selected from the group consisting of natural rubber and neoprene.

20. The exercise apparatus as claimed in claim 14, wherein at least two of the plurality of second longitudinal sections are longitudinally adjacent to one another and wherein one of said plurality of first longitudinal sections is at one axial end of the apparatus and another one of said plurality of first longitudinal sections is at the other axial end of the apparatus.

21. The exercise apparatus as claimed in claim 14, wherein there are two of said first longitudinal sections and two of said second longitudinal sections.

22. The exercise apparatus as claimed in claim 14, including gripping members installed on each end of the apparatus and between each adjacent pair of said longitudinal sections.

23. An exercise apparatus which comprises a flexible, axially-resilient member having two first longitudinal sections each having a first resistance to stretching and two second longitudinal sections each having a second resistance to stretching, said second resistance to stretching being greater than said first resistance to stretching, said first longitudinal sections and said second longitudinal sections being arranged in a series with one another and being constructed of an elastomeric material in the shape of a tube having a uniform outer diameter and having a uniform wall thickness, each of said first longitudinal sections having a smaller transverse cross sectional area than that of each of said second longitudinal sections, and further including gripping members installed on each adjacent pair of said longitudinal sections.

24. The exercise apparatus as claimed in claim 23, wherein both of said second longitudinal sections are longitudinally adjacent to one another.

25. The exercise apparatus as claimed in claim 24, wherein one of said first longitudinal sections is at one axial end of the apparatus and the other one of said first longitudinal sections is at the other end of the apparatus.

26. The exercise apparatus as claimed in claim 23, wherein each of said first longitudinal sections is formed having at least one first longitudinal opening in the wall of said tube whereby the cross sectional area of the tube in the region of said at least one first longitudinal opening is equal to a first cross sectional area and wherein each of said second longitudinal sections is formed having at least one second longitudinal opening in the wall of said tube whereby the cross sectional area of the tube in the region of said at least one second longitudinal opening is equal to a second cross sectional area which is substantially greater than said first cross sectional area.

27. The exercise apparatus as claimed in claim 23, wherein said elastomeric material is selected from the group consisting of natural rubber and neoprene.

28. The exercise apparatus as claimed in claim 23, wherein each of said first and second longitudinal sections is about nine inches long, whereby the apparatus has a total length of about 36 inches.

29. An exercise apparatus which comprises a flexible, axially-resilient member having two first longitudinal sections each having a first resistance to stretching and two second longitudinal sections each having a second resistance to stretching, said first and second longitudinal sections being arranged in series with one of said first longitudinal sections at one axial end of the apparatus and the other one of said first longitudinal sections at the other axial end of the apparatus, with the two second longitudinal sections adjacent one another between the two first longitudinal sections, said first and second longitudinal sections being constructed of either natural rubber or neoprene, and being in the shape of a tube having a uniform outer diameter and a uniform wall thickness, said apparatus further comprising gripping members installed on each end of the apparatus and between each adjacent pair of said longitudinal sections.

30. The exercise apparatus as claimed in claim 29, wherein each of said first longitudinal sections is formed having at least one longitudinal opening in the wall of said tube whereby the cross sectional area of the tube in the region of said at least one longitudinal opening is equal to a first cross sectional area and wherein each of said second longitudinal sections is formed having at least one second longitudinal opening in the wall of said tube whereby the cross sectional area of the tube in the region of said at least one second longitudinal opening is equal to a second cross sectional area which is substantially greater than said first cross sectional area, whereby said second longitudinal sections have a resistance to stretching which is substantially greater than that of said first longitudinal sections.

31. The exercise apparatus as claimed in claim 29, wherein each of said first and second longitudinal sections is about nine inches long, whereby the apparatus has a total length of about 36 inches.

* * * * *